US008910587B2

(12) United States Patent
Sakura et al.

(10) Patent No.: US 8,910,587 B2
(45) Date of Patent: Dec. 16, 2014

(54) IMAGE FORMING APPARATUS AND LIQUID APPLICATION DEVICE

(75) Inventors: Shozo Sakura, Kanagawa (JP); Satoshi Kitaoka, Kanagawa (JP); Shinji Imoto, Tokyo (JP); Hiroyoshi Komaba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/315,537

(22) Filed: Dec. 9, 2011

(65) Prior Publication Data

US 2012/0160161 A1 Jun. 28, 2012

(30) Foreign Application Priority Data

Dec. 24, 2010 (JP) ..... 2010-288835

(51) Int. Cl.

*B05C 1/02* (2006.01)
*B41J 2/005* (2006.01)
*B41J 11/00* (2006.01)

(52) U.S. Cl.

CPC ..... *B41J 2/0057* (2013.01); *B05C 1/027* (2013.01); *B05C 1/02* (2013.01); *B41J 11/0015* (2013.01)

USPC ..... 118/256; 118/261; 118/262; 347/101; 347/103

(58) Field of Classification Search

CPC ..... B05C 1/02; B05C 1/027; B41J 11/0015; B41J 2/0057

USPC ..... 118/256, 261, 262; 492/56, 48, 49; 101/424.2, 416.1, 375; 347/101, 103; 29/895.32; 242/610, 610.4, 610.6; 226/186, 190; 399/286, 322, 328

See application file for complete search history.

(56) References Cited

U.S. PATENT DOCUMENTS

| | | | | |
|---|---|---|---|---|
| 3,447,221 | A * | 6/1969 | Odiorne | 492/57 |
| 4,949,667 | A * | 8/1990 | Yoshida et al. | 118/60 |
| 5,813,961 | A * | 9/1998 | Buchwald | 492/56 |
| 6,183,079 | B1 * | 2/2001 | Meade et al. | 347/101 |
| 7,127,991 | B2 * | 10/2006 | Hoffmann et al. | 101/216 |
| 8,136,936 | B2 | 3/2012 | Hook et al. | |

(Continued)

FOREIGN PATENT DOCUMENTS

| | | |
|---|---|---|
| CN | 101421110 | 4/2009 |
| CN | 101835611 | 9/2010 |

(Continued)

OTHER PUBLICATIONS

U.S. Appl. No. 13/158,767, filed Jun. 13, 2011.

(Continued)

*Primary Examiner* — Laura Edwards
(74) *Attorney, Agent, or Firm* — Cooper & Dunham LLP

(57) ABSTRACT

An image forming apparatus includes an application device. The application device has an application roller to apply a treatment liquid onto a recording medium before an image is formed on the recording medium. The application roller has a core member serving as a rotation shaft of the application roller and an elastic surface member disposed around the core member. The core member has a plurality of convex ring portions formed along a circumferential direction of the core member around a circumferential surface of the core member and a plurality of concave ring portions formed between the plurality of convex ring portions. The convex ring portions and the concave ring portions are alternately arranged.

14 Claims, 3 Drawing Sheets

(56) References Cited

U.S. PATENT DOCUMENTS

| | | | | |
|---|---|---|---|---|
| 8,177,351 | B2 | 5/2012 | Taniuchi et al. | |
| 8,328,349 | B2 | 12/2012 | Hook et al. | |
| 8,434,860 | B2 | 5/2013 | Hook et al. | |
| 8,496,326 | B2 | 7/2013 | Hook et al. | |
| 2008/0296810 | A1* | 12/2008 | Pellengo Gatti | 264/505 |
| 2009/0027473 | A1 | 1/2009 | Taniuchi et al. | |
| 2009/0056577 | A1 | 3/2009 | Hook et al. | |
| 2009/0064884 | A1 | 3/2009 | Hook et al. | |
| 2009/0064886 | A1 | 3/2009 | Hook et al. | |
| 2009/0151625 | A1 | 6/2009 | Matsumoto et al. | |
| 2010/0245460 | A1 | 9/2010 | Imoto et al. | |
| 2011/0057988 | A1 | 3/2011 | Izumikawa et al. | |
| 2011/0220017 | A1 | 9/2011 | Kitaoka et al. | |
| 2011/0290133 | A1 | 12/2011 | Hook et al. | |
| 2012/0111212 | A1 | 5/2012 | Hook et al. | |
| 2013/0120512 | A1 | 5/2013 | Hook et al. | |

FOREIGN PATENT DOCUMENTS

| | | |
|---|---|---|
| JP | 58-140933 | 9/1983 |
| JP | 61-183678 | 8/1986 |
| JP | 2006-242352 | 9/2006 |
| JP | 2007-117807 | 5/2007 |
| JP | 2010-167371 | 8/2010 |

OTHER PUBLICATIONS

U.S. Appl. No. 13/225,914, filed Sep. 6, 2011.
Chinese official action dated Dec. 16, 2013 in corresponding. Chinese patent application No. 2011 10 42 4866.1.

* cited by examiner

IMAGE FORMING APPARATUS AND LIQUID APPLICATION DEVICE

CROSS-REFERENCE TO RELATED APPLICATIONS

This patent application is based on and claims priority pursuant to 35 U.S.C. §119 to Japanese Patent Application No. 2010-288835, filed on Dec. 24, 2010, in the Japan Patent Office, the entire disclosure of which is hereby incorporated by reference herein.

TECHNICAL FIELD

This disclosure relates to a liquid application device and an image forming apparatus, and more specifically to a liquid application device that applies treatment liquid to a recording medium to prevent bleeding of ink on the medium and an image forming apparatus including the liquid application device.

DESCRIPTION OF THE BACKGROUND ART

Image forming apparatuses are used as printers, facsimile machines, copiers, plotters, or multi-functional devices having two or more of the foregoing capabilities. As one type of image forming apparatus, image forming apparatuses employing a liquid-ejection recording method are known that use a recording head(s) to eject droplets of ink or other liquid. During image formation, such liquid-ejection-type image forming apparatuses eject droplets of ink or other liquid from the recording head onto a recording medium to form (record or print) a desired image on the recording medium.

Such liquid-ejection-type image forming apparatuses fall into two main types: a serial-type image forming apparatus that forms an image by ejecting droplets from the recording head while moving the recording head in a main scanning direction of the carriage, and a line-head-type image forming apparatus that forms an image by ejecting droplets from a linear-shaped recording head held stationary in the image forming apparatus.

Such liquid-ejection-type image forming apparatuses may have image failures, such as "feathering" in which dots formed with liquid droplets blur in a jaggy shape on the recording medium and "color bleeding" in which, e.g., ink droplets of different colors mix each other at adjacent areas on the recording medium to blur color boundaries. Such liquid-ejection-type image forming apparatuses may also take a relatively long time to dry droplets on a recording medium after image formation.

Hence, several types of conventional image forming apparatuses are proposed that have a liquid application device to apply treatment liquid onto a recording medium to prevent bleeding of ink on the recording medium. A conventional image forming apparatus using a liquid toner in which toner particles are dispersed in a carrier liquid, such as silicone oil or mineral oil, has a developing roller to develop an electrostatic latent image on a photoconductor and a toner application roller serving as a liquid application device to form a thin layer of the liquid toner on the developing roller. The toner application roller has grooves on its surface layer, and the surface of the grooves is nitrified.

Another conventional image forming apparatus has a liquid-amount regulation member, an application control unit, and a pressing roller as the liquid application device. In applying an application liquid to a target member, after the target material passes the liquid-amount regulation member and before the application liquid is applied to the target member, the application control unit uses the liquid-amount regulation member to regulate the application liquid on the surface of an application roller at a certain amount. The pressing roller presses the target member against the application roller to apply the application liquid from the surface of the application roller to the target member. The application control unit separates the application roller from the liquid-amount regulation member while the application liquid is not applied to the target member.

In such liquid application devices, typically, the application roller contacts a squeeze roller at a high pressure to minimize fluctuations in the application amount of treatment liquid caused by changes in the ambient environment and the transport speed of the recording medium. Such a configuration can stabilize the application amount of treatment liquid, but may reduce the application amount, thus hampering application of the desired amount of treatment liquid.

BRIEF SUMMARY

In an aspect of this disclosure, there is provided an improved image forming apparatus including an application device. The application device has an application roller to apply a treatment liquid onto a recording medium before an image is formed on the recording medium. The application roller has a core member serving as a rotation shaft of the application roller and an elastic surface member disposed around the core member. The core member has a plurality of convex ring portions formed along a circumferential direction of the core member around a circumferential surface of the core member and a plurality of concave ring portions formed between the plurality of convex ring portions. The convex ring portions and the concave ring portions are alternately arranged.

In another aspect of this disclosure, there is provided an improved liquid application device including an application roller to apply a treatment liquid onto a recording medium before an image is formed on the recording medium. The application roller has a core member serving as a rotation shaft of the application roller and an elastic surface member disposed around the core member. The core member has a convex and concave surface. The convex and concave surface has a plurality of convex ring portions formed along a circumferential direction of the core member around a circumferential surface of the core member and a plurality of concave ring portions formed between the plurality of convex ring portions. The convex ring portions and the concave ring portions are alternately arranged.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
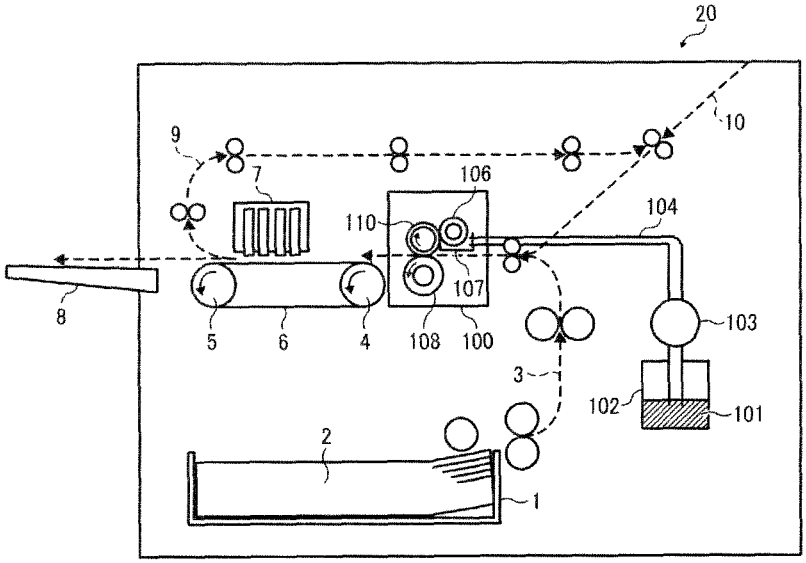
FIG. 1 is a schematic cross-sectional view of an image forming apparatus according to a first exemplary embodiment.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, a recording sheet, and a recording paper sheet. The term "image forming apparatus" of liquid ejection type refers to an apparatus that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. In other words, the term "image formation" includes only landing droplets onto the medium.

The term "ink" used herein is not limited to "ink" in a narrow sense and includes anything ejected in a liquid form, such as a DNA sample, resist, and pattern material. The term "image" used herein is not limited to a two-dimensional image and includes, for example, an image applied to a three dimensional object and a three dimensional object itself formed as a three-dimensionally molded image. Although a liquid-ejection-type image forming apparatus is described below, the term "image forming apparatus" used herein is not limited to the liquid-ejection-type image forming apparatus and may be, for example, electrophotographic image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

An image forming apparatus according to an exemplary embodiment has a liquid application device with an application roller to apply a treatment liquid onto a sheet. The application roller of the liquid application device has a core member serving as a rotation shaft and an elastic surface member disposed around the core member. The core member has a convex-and-concave surface. The convex-and-concave surface has multiple convex ring portions formed along a circumferential direction around the surface of the core member and multiple concave ring portions formed between and alternately with the respective convex ring portions. The pitch and shape of the convex ring portions and the concave ring portions are adjusted to optimize the elasticity of the surface member. Thus, in a case in which the application roller contacts a squeeze roller at a high pressure, the application amount of treatment liquid can be properly controlled.

First Exemplary Embodiment

An image forming apparatus according to a first exemplary embodiment of this disclosure is described below.

First, a general configuration of the image forming apparatus is described below.

FIG. 1 is a schematic cross-sectional view of an image forming apparatus 20 according to the first exemplary embodiment.

The image forming apparatus 20 has a sheet feed tray 1 to store sheets 2, a recording head 7 to eject ink, a conveyance belt 6 to convey the sheets 2, a sheet transport path 3 to transport the sheets 2 to the conveyance belt 6, and a treatment-liquid application device 100 serving as a liquid application device. The conveyance belt 6 is disposed below the recording head 7 and is a looped belt member wound around a conveyance roller 4 and a tension roller 5. The treatment-liquid application device 100 has an application roller 110 and applies a treatment liquid 101 onto a sheet 2 at a position upstream from the recording head 7 in a direction in which the sheet 2 is transported along the sheet transport path 3.

When the image forming apparatus 20 performs simplex printing, the sheets 2 are fed sheet by sheet from the sheet feed tray 1 and transported along the sheet transport path 3 to the treatment-liquid application device 100. In the treatment-liquid application device 100, the application roller 110 applies the treatment liquid 101 onto the sheet 2. When the sheet 2 applied with the treatment liquid 101 is transported onto the conveyance belt 6, the recording head 7 disposed above the conveyance belt 6 forms an image on the sheet 2. The sheet 2 having the image formed thereon is discharged to the sheet output tray 8.

In duplex printing, after an image is formed on a first face of the sheet 2, the sheet 2 is transported to a sheet reverse section 10 via a duplex transport path 9. After the sheet 2 is reversed at the sheet reverse section 10, the sheet 2 is transported again to the treatment-liquid application device 100 and the application roller 110 applies the treatment liquid 101 onto a second face of the sheet 2. When the recording head 7 forms an image on the second face of the sheet 2, the sheet 2 having the images on both the first and second faces is discharged to the sheet output tray 8.

Next, the treatment-liquid application device 100 is described below.

Figure 2:
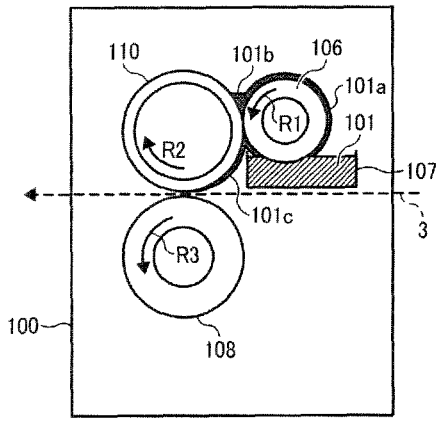
FIG. 2 is a schematic cross-sectional view of a treatment-liquid application device of the image forming apparatus of FIG. 1.

FIG. 2 is a schematic cross-sectional view of a configuration of the treatment-liquid application device 100. In FIG. 2, the treatment-liquid application device 100 has a conveyance roller 108, an application roller 110, and a squeeze roller 106.

The conveyance roller 108 conveys the sheet 2, and the application roller 110 is disposed opposing the conveyance roller 108 to contact the conveyance roller 108 to apply the treatment liquid 101 onto the sheet 2. With being immersed into the treatment liquid 101 stored in a pan 107, the squeeze roller 106 rotates to transfer the treatment liquid 101 onto the application roller 110 while forming a liquid layer of the treatment liquid 101 on the application roller 110 at a proper thickness. The squeeze roller 106, the application roller 110, and the conveyance roller 108 rotate in directions indicated by arrows R1, R2, and R3, respectively, in FIG. 2. As illustrated in FIG. 1, the treatment liquid 101 is stored in a treatment-liquid tank 102 and delivered to the pan 107 via a treatment-liquid delivery path 104 with a pump 103.

The treatment liquid 101 is a modifier applied to a surface of the sheet 2 to modify properties of the surface of the sheet 100. For example, the treatment liquid 101 may be a fixing agent (setting agent) that is uniformly applied over the sheet 2 before image formation to cause the moisture of ink to promptly penetrate into the sheet 2, increase the viscosity of color components, and speed up drying of ink, thus preventing feathering, bleeding, and/or offset of ink and enhancing the productivity (e.g., the number of image outputs per unit time).

Regarding the composition, for example, the treatment liquid 101 may be a solution containing a surface acting agent (for example, an anionic, cationic, or nonionic agent or a mixed agent including two or more of the foregoing types), a cellulosic material (e.g., hydroxypropyl cellulose) for facilitating the penetration of moisture, and a base material such as talc powder. Further, the solution may contain fine particles.

In the treatment-liquid application device 100, the conveyance roller 108 is arranged to contact the application roller 110, and the application roller 110 is arranged to contact the squeeze roller 106. A treatment liquid 101*a* adhering around the squeeze roller 106 is transferred onto the application roller 110, and a liquid layer 101*c* of the treatment liquid 101 is formed at a desired thickness on the application roller 110. In this state, when the application roller 110 rotates (in the direction indicated by the arrow R2 in FIG. 2), the treatment liquid 101 is carried to a portion of the application roller 110 opposing the conveyance roller 108 and applied onto the sheet 2 on the sheet transport path 3.

Next, a configuration of the application roller 110 is described below.

Figure 3:
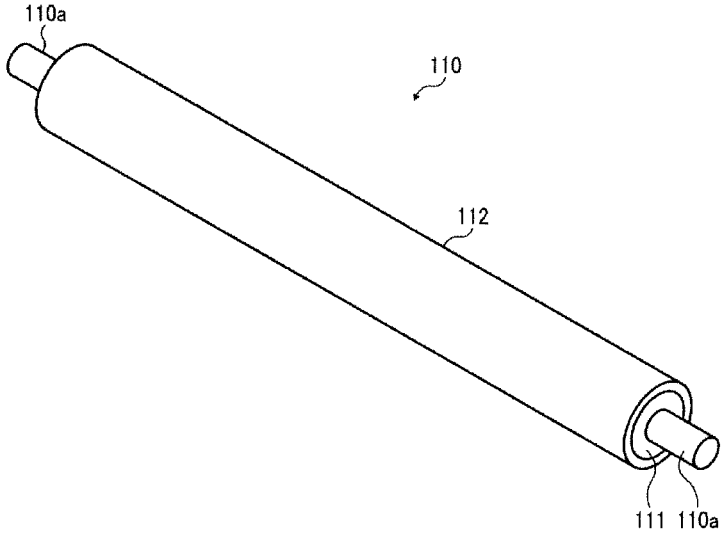
FIG. 3 is a perspective view of an application roller of the liquid application device of FIG. 2.
Figure 4A:
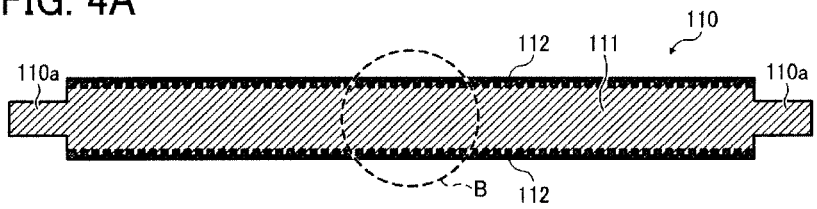
FIG. 4A is a cross-sectional view of the application roller of FIG. 3 cut along an axial direction of the roller.
Figure 4B:
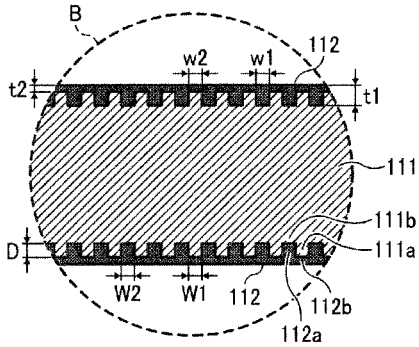
FIG. 4B is an enlarged view of a portion of the application roller indicated by a circle B in FIG. 14A.
Figure 5:
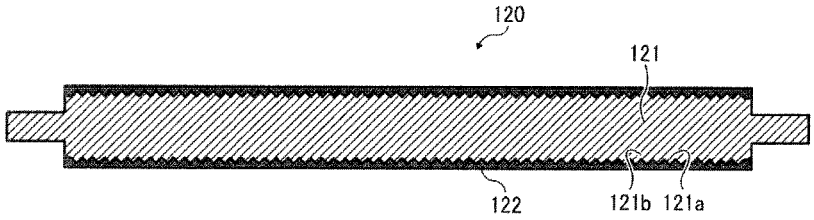
FIG. 5 is a cross-sectional view of an application roller of a liquid application device according to a second exemplary embodiment cut along an axial direction of the application roller.

FIG. 3 is a perspective view of the application roller 110. FIG. 4A is a cross-sectional view of the application roller 100 cut along an axial direction of the application roller 110. FIG. 4B is an enlarged view of a portion of the application roller 100 indicated by a circle B in FIG. 4A.

The application roller 110 has a core member 111 serving as a rotation shaft and a surface member 112 disposed around the core member 111 to contact a sheet on the sheet transport path 3. In this first exemplary embodiment, the core member 111 is, e.g., metal or synthetic resin. As the surface member 112, for example, a rubber member is molded around the core member 111.

In this first exemplary embodiment, shaft portions 110*a* are formed at opposed ends of the core member 111 in an axial direction of the core member 111. The core member 111 has multiple convex ring portions 111*a* formed along a circumferential direction of the core member around a circumferential surface of the core member, and multiple concave ring portions 111*b* formed between the convex ring portions 111*a* so that the concave ring portions 111*b* and the convex ring portions 111*a* are alternately arranged in the axial direction of the core member 111. The convex ring portions 111*a* and the concave ring portions 111*b* are rectangular in a cross section cut along the axial direction of the core member 111. In FIG. 4B, the height and width of the convex ring portions 111*a* in the cross section cut along the axial direction are represented by D and W1, respectively, and the height and width of the concave ring portions 111*b* in the cross section are represented by D (equal to the height D of the convex ring portions 111*a*) and W2, respectively.

The surface member 112 is molded around the surface of the core member 111 and has concave ring portions 112*b* corresponding to the convex ring portions 111*a* of the core member 111 and convex ring portions 112*a* corresponding to the concave ring portions 111*b* of the core member 111. In FIG. 4A, the thickness and width of the convex ring portions 112*a* in the cross section along the axial direction are represented by t1 and w1, respectively, and the thickness and width of the concave ring portions 112*b* in the cross section are represented by t2 and w2, respectively.

In the first exemplary embodiment, the dimensions of the convex ring portions 111*a* and the concave ring portions 111*b* of the core member 111 are determined in accordance with a pressure at which the application roller 110 contacts the squeeze roller 106. Accordingly, the elasticity (hardness) of the surface member 112 is set to an optimal value, thus allowing the treatment liquid to be applied at an optimal application amount.

In other words, to apply a greater amount of the treatment liquid 101 by the application roller 110, the width W2 and/or thickness D of the concave ring portions 111*b* of the core member 111 are/is increased. As a result, the width w1 and/or thickness t1 of the convex ring portions 112*a* of the surface member 112 formed around the surface of the core member 111 also increase/increases, and the proportion of the convex ring portions 112*a* in the surface member 112 increases. Accordingly, the surface elasticity of the surface member 112 increases, thus reducing the hardness.

By contrast, to apply a smaller amount of the treatment liquid 101 by the application roller 110, the width W1 and/or thickness D of the convex ring portions 111*a* of the core member 111 are/is increased. As a result, the width w1 and/or thickness t1 of the convex ring portions 112*a* of the surface member 112 formed around the surface of the core member 111 decrease/decreases, and the proportion of the concave ring portions 112*b* in the surface member 112 decreases. Accordingly, the surface elasticity of the surface member 112 decreases, thus increasing the hardness.

As described above, in the first exemplary embodiment, by changing the shape of the core member 111 of the application roller 110, the elasticity of the surface member 112 can be adjusted. As a result, even in a case in which the application roller 110 contacts the squeeze roller 106 at a relatively high pressure, a desired application amount of treatment liquid can be obtained by changing the shape of the core member 111. Thus, even in a case in which the contact pressure is increased to obtain a larger nip of the surface member 112, an optimal amount of the treatment liquid can be applied.

Such a configuration can minimize influence of minute irregularities of the surface member 112 to the application amount of the treatment liquid 101, thus minimizing variations in the treatment liquid applied to the sheet 2. To minimize uneven application of the treatment liquid in the axial direction (sheet width direction) of the application roller 110 on the sheet 2, the widths W1 and W2 of the convex ring portions 111*a* and the concave ring portions 111*b* are, preferably, 5 mm or smaller, further preferably, approximately 2.5 mm.

Second Exemplary Embodiment

A liquid application device according to a second exemplary embodiment of this disclosure is described below.

Except for the configuration of an application roller, the liquid application device according to the second exemplary embodiment has substantially the same configuration as the configuration of the liquid application device according to the first exemplary embodiment.

As with the first exemplary embodiment, an application roller 120 of the second exemplary embodiment has a core member 121 and a surface member 122. Convex ring portions 121*a* and concave ring portions 121*b* of the core member 121 are triangle in a cross section cut along an axial direction of the core member 121. In the second exemplary embodiment, as with the first exemplary embodiment, by setting the distributions and shapes of the convex ring portions 121*a* and the concave ring portions 121*b* properly, the elasticity and hardness of the surface member 122 are adjusted across the whole area in the axial direction of the application roller. Additionally, in the second exemplary embodiment, the core member 111 can more easily be processed as compared to the configuration in which the convex ring portions and the concave ring portions have rectangular shapes in the cross section in the axial direction of the core member.

Third Exemplary Embodiment

A liquid application device according to a third exemplary embodiment of this disclosure is described below.

Except for the configuration of an application roller, the liquid application device according to the third exemplary embodiment has substantially the same configuration as the configuration of the liquid application device according to the first exemplary embodiment.

Figure 6:
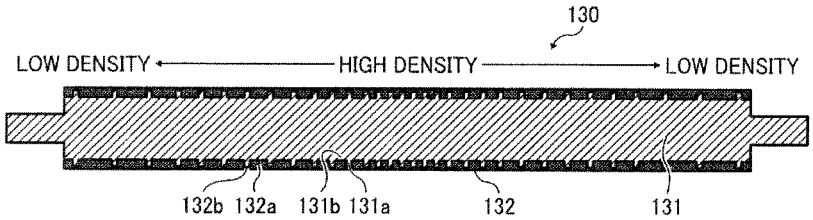
FIG. 6 is a cross-sectional view of an application roller of a liquid application device according to a third exemplary embodiment cut along an axial direction of the application roller.
Figure 7A:
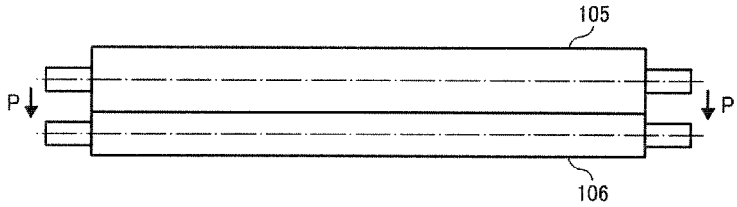
FIG. 7A is a plan view of an application roller and a squeeze roller according to a comparative example in a state in which the application roller contacts the squeeze roller.
Figure 7B:
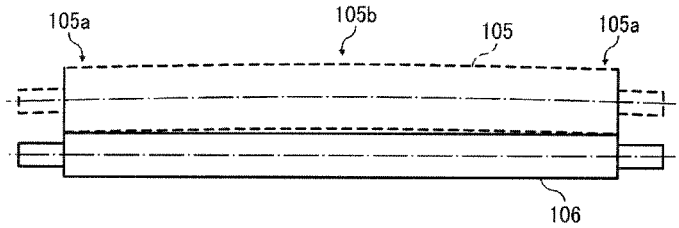
FIG. 7B is a plan view of the application roller and the squeeze roller of FIG. 7A in a state in which the application roller is bent by pressure.

FIG. 6 is a cross-sectional view of an application roller of the liquid application device according to the third exemplary embodiment cut along an axial direction of the application roller. FIGS. 7A and 7B are plan views of a comparative example of an application roller contacting a squeeze roller.

As illustrated in FIG. 7A, in liquid application devices, generally, an application roller 105 is pressed against a squeeze roller 106 to form a thin layer of treatment liquid on the application roller 105. When pressure is applied to shaft portions at opposed ends of each of the application roller 105 and the squeeze roller 106 in directions indicated by arrows P in FIG. 7A, as illustrated in FIG. 7B, the application roller 105 is bent, thus hampering uniform application of pressure across the whole area in the axial direction of the application roller 105. As a result, the pressure of the application roller 105 against the squeeze roller 106 is higher at opposed end portions 105*a* than at a middle portion 105*b*. In this state, the amount of treatment liquid applied to lateral end portions of a sheet becomes lower than that applied to a middle portion of the sheet. By contrast, as described below, the configuration of the third exemplary embodiment allows the treatment liquid to be uniformly applied to the sheet even when the application roller is bent by pressure.

In the third exemplary embodiment, as with the first exemplary embodiment, an application roller 130 has a core member 131 and a surface member 132. The core member 131 has convex ring portions 131*a*, and the pitch of the convex ring portions 131*a* is relatively small (more dense) at a middle portion of the core member 131 and increasingly larger (less dense) toward each of opposed ends in the axial direction of the core member 131. As a result, the hardness of the surface member 132 is relatively high at a middle portion and increasingly lower (more elastic) toward each of opposed ends of the surface member 132 in the axial direction of the core member 131. Such a configuration allows uniform application of the treatment liquid even in a state in which the pressure of the application roller is lower at the middle portion than at the opposed ends.

It is to be noted that, in any of the above-described exemplary embodiments, the core member may be formed of synthetic resin because the application amount of treatment liquid can be stable and uniform without increasing the pressure at which the application roller 105 contacts the application roller 105.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising an application device, the application device having an application roller to apply a treatment liquid onto a recording medium with the treatment liquid carried on a surface of the application roller before an image is formed on the recording medium;

a conveyance roller disposed opposite the application roller, to convey the recording medium;

a pan to store the treatment liquid; and a squeeze roller disposed to squeeze the treatment liquid in the pan to supply the treatment liquid to the application roller, wherein the squeeze roller and the application roller are disposed in contact with, and adjacent to, each other in a horizontal or lateral direction, and with the treatment liquid retained on a surface of the application roller, the application roller, from above the recording medium, applies the treatment liquid onto an image formation face of the recording medium, and wherein the application roller has a core member serving as a rotation shaft of the application roller and an elastic surface member disposed around the core member, the core member has a plurality of convex ring portions formed around a circumferential surface of the core member and a plurality of concave portions formed between the plurality of convex ring portions, and the plurality of convex ring portions and the plurality of concave portions are alternately arranged in an axial direction of the core member, wherein pitches between adjacent ones of the plurality of convex ring portions in the axial direction of the core member are gradually smaller from each end portion of the core member to a middle portion in the axial direction of the core member.

2. The image forming apparatus according to claim 1, wherein the plurality of concave portions have a plurality of different pitches in an axial direction of the application roller.

3. The image forming apparatus according to claim 1, wherein at least one of the plurality of convex ring portions and the plurality of concave portions has a plurality of different shapes in an axial direction of the application roller.

4. The image forming apparatus according to claim 1, wherein the plurality of convex ring portions and the plurality of concave portions are rectangular in a cross section cut along an axial direction of the application roller.

5. The image forming apparatus according to claim 1, wherein the plurality of convex ring portions and the plurality of concave portions are triangle in a cross section cut along an axial direction of the application roller.

6. The image forming apparatus according to claim 1, wherein the core member is resin.

7. The image forming apparatus according to claim 1, wherein the surface member has a plurality of convex ring portions and a plurality of concave portions corresponding to the plurality of concave portions and the plurality of convex ring portions, respectively, of the core member.

8. The image forming apparatus according to claim 1, wherein shaft portions of both ends of the application roller in the axial direction are pressed to contact the squeeze roller, and the treatment liquid is supplied from the squeeze roller to the application roller with the application roller contacting the squeeze roller.

9. The image forming apparatus according to claim 1, wherein the greater pitches between the convex ring portions n the end portion of the core member relative to those between the convex ring portions in the middle portion in the axial direction of the core member are configured to cause relatively uniform application of the treatment liquid by the application roller.

10. The image forming apparatus according to claim 1, wherein a rotation direction of the application roller is opposite to a rotation direction of the conveyance roller, and a rotation direction of the squeeze roller is the same as the rotation direction of the conveyance roller.

11. A liquid application device comprising an application roller to apply a treatment liquid onto a recording medium with the treatment liquid carried on a surface of the application roller before an image is formed on the recording medium;

a conveyance roller disposed opposite the application roller, to convey the recording medium;

a pan to store the treatment liquid; and a squeeze roller disposed to squeeze the treatment liquid in the pan to supply the treatment liquid to the application roller, wherein the squeeze roller and the application roller are disposed in contact with, and adjacent to, each other in a horizontal or lateral direction, and with the treatment liquid retained on a surface of the application roller, the application roller, from above the recording medium, applies the treatment liquid onto an image formation face of the recording medium, wherein the application roller has a core member serving as a rotation shaft of the application roller and an elastic surface member disposed around the core member, the core member has a convex and concave surface, the convex and concave surface has a plurality of convex ring portions formed around a circumferential surface of the core member and a plurality of concave portions formed between the plurality of convex ring portions, the plurality of convex ring portions and the plurality of concave portions are alternately arranged in art axial direction of the core member, wherein pitches between adjacent ones of the plurality of convex ring portions in the axial direction of the core member are gradually smaller from each end portion of the core member to a middle portion in the axial direction of the core member.

12. The liquid application device according to claim 11, wherein shaft portions of both ends of the application roller in the axial direction are pressed to contact the squeeze roller, and the treatment liquid is supplied from the squeeze roller to the application roller with the application roller contacting the squeeze roller.

13. The liquid application device according to claim 11, wherein the greater pitches between the convex ring portions in the end portion of the core member relative to those between the convex ring portions in the middle portion in the axial direction of the core member are configured to cause relatively uniform application of the treatment liquid by the application roller.

14. The liquid application device according to claim 11, wherein a rotation direction of the application roller is opposite to a rotation direction of the conveyance roller, and a rotation direction of the squeeze roller is the same as the rotation direction of the conveyance roller.

* * * * *